US006836905B2

(12) United States Patent
Sande

(10) Patent No.: US 6,836,905 B2
(45) Date of Patent: Jan. 4, 2005

(54) FLEXIBLE FINGER SYSTEM FOR HOCKEY GLOVE

(75) Inventor: Gary A. Sande, Mission (CA)

(73) Assignee: Sande Hockey Inc., Abbotsford (CA)

( * ) Notice: Subject to any disclaimer, the term of this patent is extended or adjusted under 35 U.S.C. 154(b) by 148 days.

(21) Appl. No.: 10/248,088

(22) Filed: Dec. 17, 2002

(65) Prior Publication Data

US 2004/0111785 A1 Jun. 17, 2004

(51) Int. Cl.[7] ..... A41D 19/00
(52) U.S. Cl. ..... 2/161.1; 2/163
(58) Field of Search ..... 2/16, 20, 159, 2/160, 161.1, 161.2, 161.5, 161.6, 163; 473/205

(56) References Cited

U.S. PATENT DOCUMENTS 2,379,430 A 7/1945 Frost
3,975,775 A * 8/1976 Alsop ..... 2/163
4,712,253 A 12/1987 Chen
4,785,477 A 11/1988 Marzo
4,907,297 A * 3/1990 Gallucci ..... 2/163
5,031,239 A 7/1991 Panichello et al.
5,237,703 A 8/1993 Brine et al.
5,598,584 A * 2/1997 Da Grossa ..... 2/159
5,680,654 A * 10/1997 McClanahan, II ..... 2/163
6,122,769 A * 9/2000 Wilder et al. ..... 2/16
6,338,163 B1 * 1/2002 Markson ..... 2/163

* cited by examiner

*Primary Examiner*—Gary L. Welch
(74) *Attorney, Agent, or Firm*—John J. Elnitski, Jr.

(57) ABSTRACT

A flexible finger system for a hockey glove. The flexible finger system includes at least one finger access hole in at least one of the fingers of the hockey glove. The flexible finger system includes an additional glove finger extending about and from each finger access hole. The additional glove finger is formed by an additional finger section attached to the sides of the glove and a finger tab extending from one of the fingers of the bottom of the glove and attached to the additional finger section. The additional finger section includes a glove section and a flexible finger section. The glove section attaches to the sides and the flexible finger section attaches to the finger tab. Wherein the attachment of the flexible finger section and the finger tab naturally forms the finger access hole to the additional glove finger.

20 Claims, 9 Drawing Sheets

FLEXIBLE FINGER SYSTEM FOR HOCKEY GLOVE

BACKGROUND OF INVENTION

The present invention generally relates to hockey gloves. More specifically, the present invention relates to a hockey glove that includes a flexible finger system of one or more independently flexible fingers to allow an improved grip on a hockey stick.

Hockey gloves are used for the protection of hands of a hockey player, while playing the sport of hockey. Hockey gloves are a requirement in many hockey leagues, including the National Hockey League played in Canada and the United States. Current hockey gloves on the market comprise an upper layer and lower layer, which together form a hand area to receive the hand of a player. The lower layer is glove shaped and is made of leather and other fabric type materials. The lower layer includes a bottom and sides. The bottom includes a palm section. Extending from the palm section are four fingers in a finger section and a thumb in a thumb section. The sides extend between the sections of the bottom and the upper layer. The sides run along the outside shape of a hand and in between each of the fingers and the thumb. The bottom and sides cover the bottom and sides of the hand of a player. The upper layer is a protective layer attached to the top of the sides, whereby the bottom of the sides is attached to the bottom of the lower layer. The protective layer includes a foam layer attached to the sides of the lower layer and covers the outside top portions of the hand for the protection of the hands. The foam layer is usually covered with a leather or vinyl type covering for durability. During movement of the hand in the hockey glove, such as grasping a hockey stick, the player pulls all the foam portions of the hockey glove about the stick, during movement of the hand. This produces an unnatural and tight feel to the hand of the player, but does not really give the player the same grip or feel, as compared to using bare hands to grip the stick. Some players will cut a hole in one or more of the fingers of the hockey glove, so that they can insert a bare finger out of the hole and improve their grip on the stick. This is not a legal practice in most hockey leagues.

It is an object of the present invention to provide a hockey glove with at least one flexible finger to improve the grip on a hockey stick when using a hockey glove.

SUMMARY OF INVENTION

A flexible finger system for a hockey glove. The flexible finger system includes at least one finger access hole in at least one of the fingers of the hockey glove. The flexible finger system includes an additional glove finger extending about and from each finger access hole. The additional glove finger is formed by an additional finger section attached to the sides of the glove and a finger tab extending from one of the fingers of the bottom of the glove and attached to the additional finger section. The additional finger section includes a glove section and a flexible finger section. The glove section attaches to the sides and the flexible finger section attaches to the finger tab. Wherein the attachment of the flexible finger section and the finger tab naturally forms the finger access hole to the additional glove finger.

DETAILED DESCRIPTION

Figure 1:
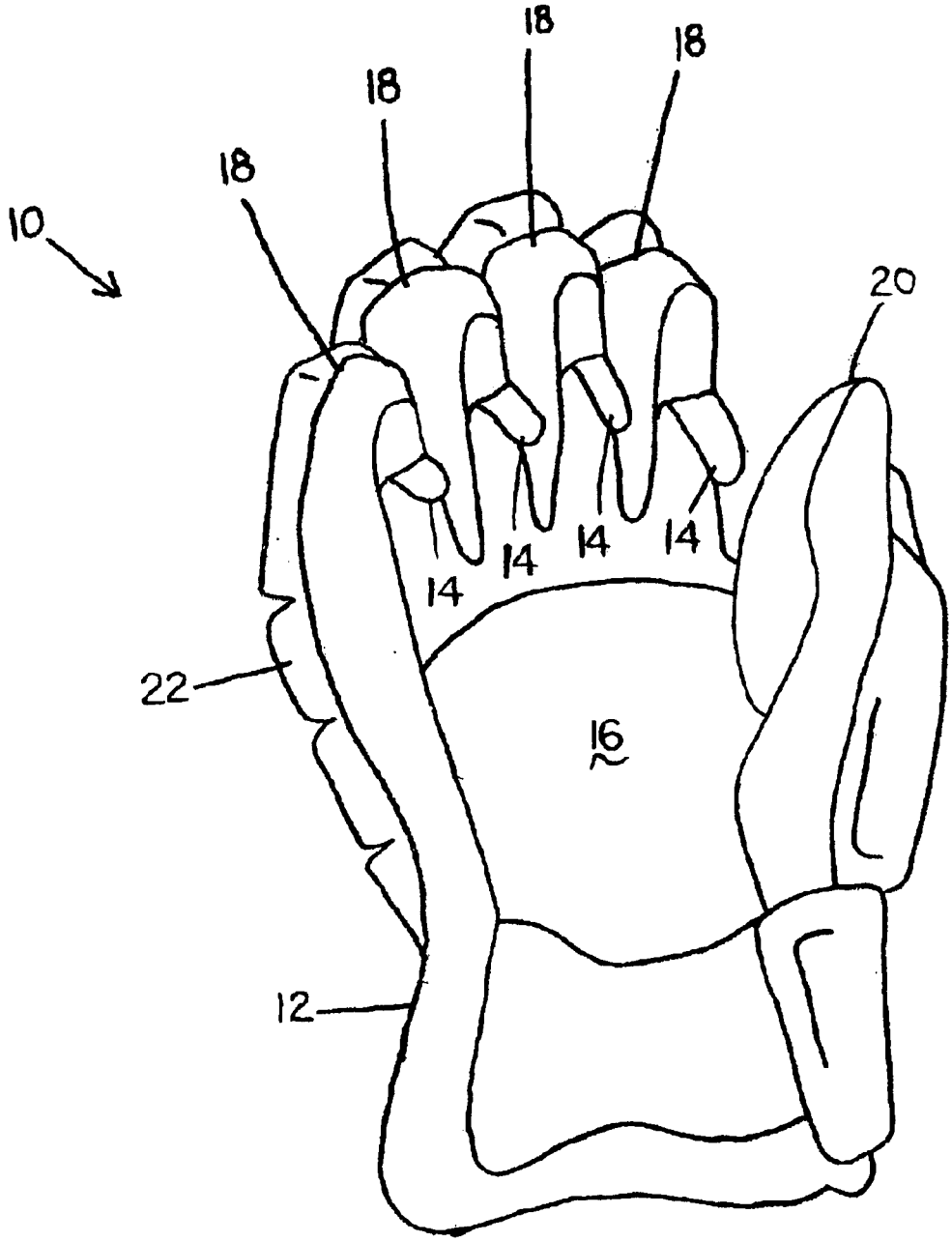
FIG. 1 is a perspective view of four additional glove fingers of a flexible finger system on a hockey glove according to the present invention.
Figure 2:
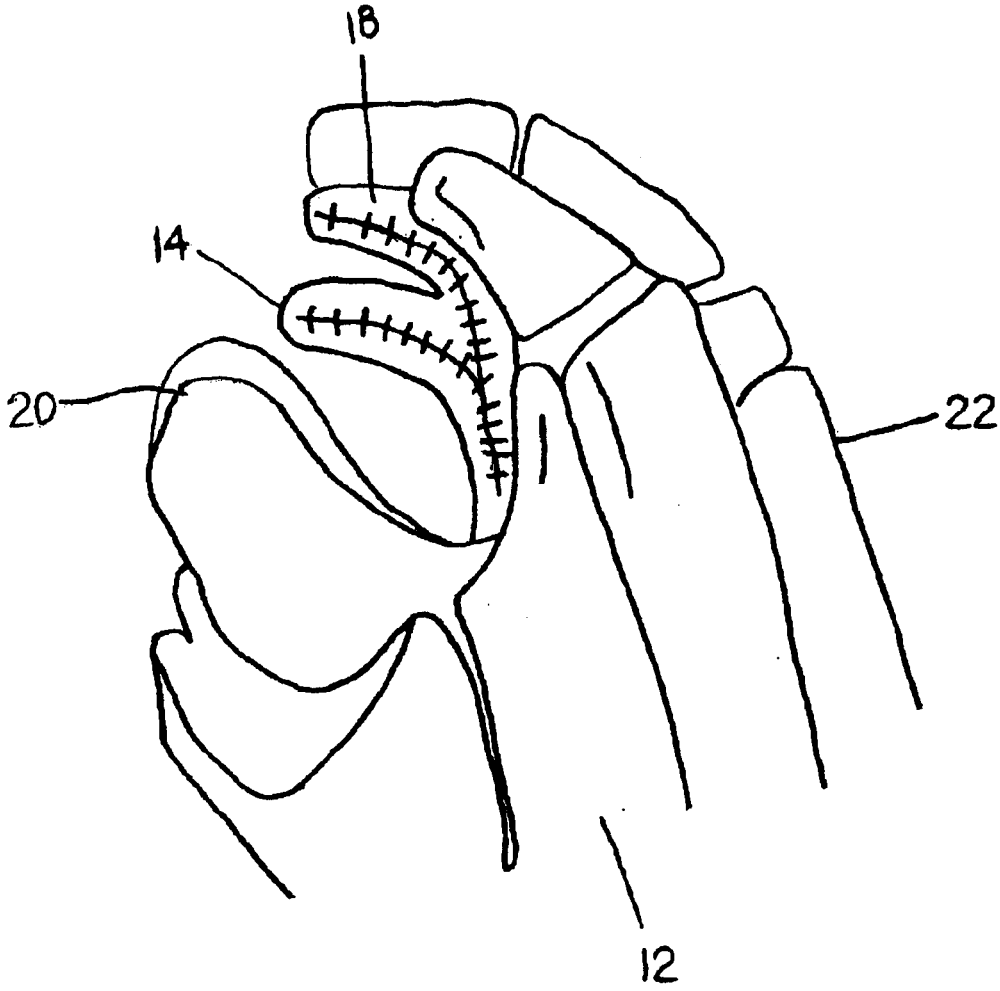
FIG. 2 is a side view of an additional glove finger according to the present invention.
Figure 3:
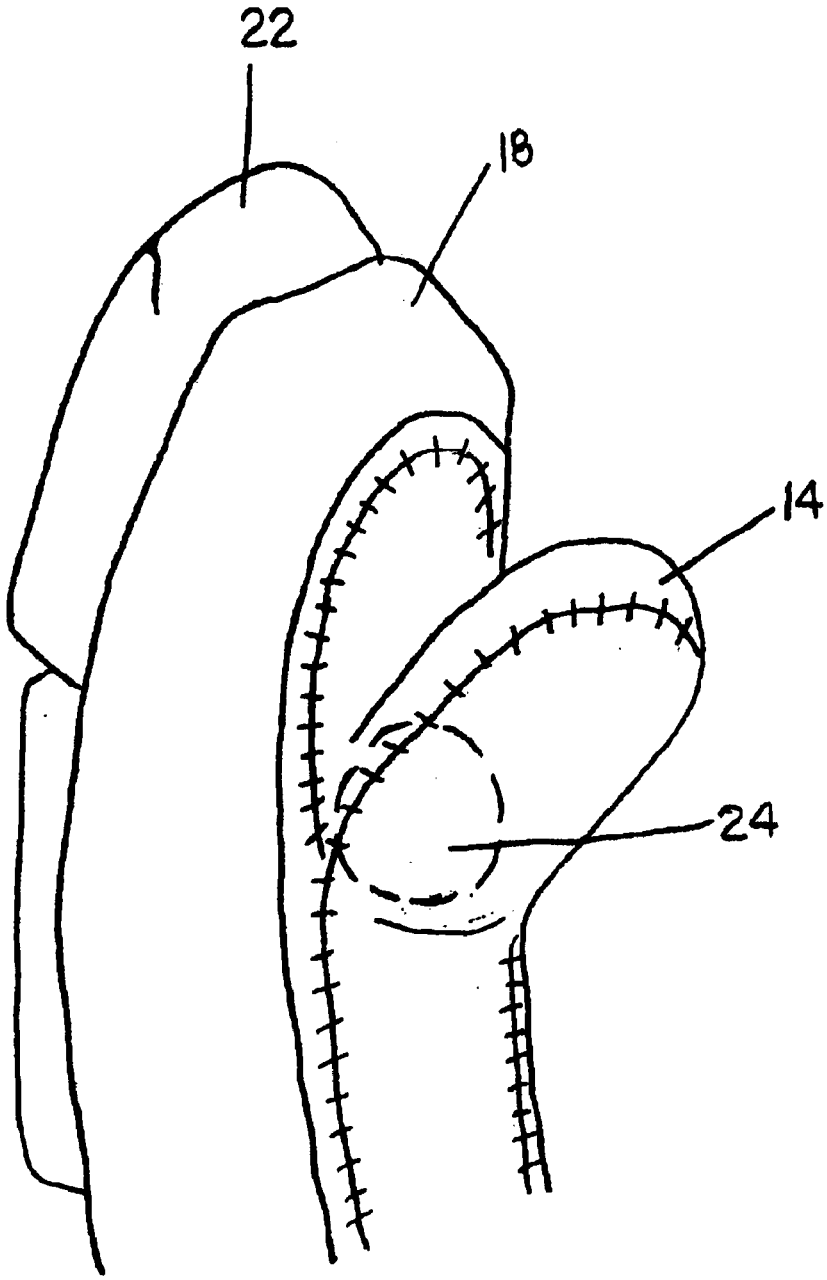
FIG. 3 is a perspective view of an additional glove finger according to the present invention.
Figure 4:
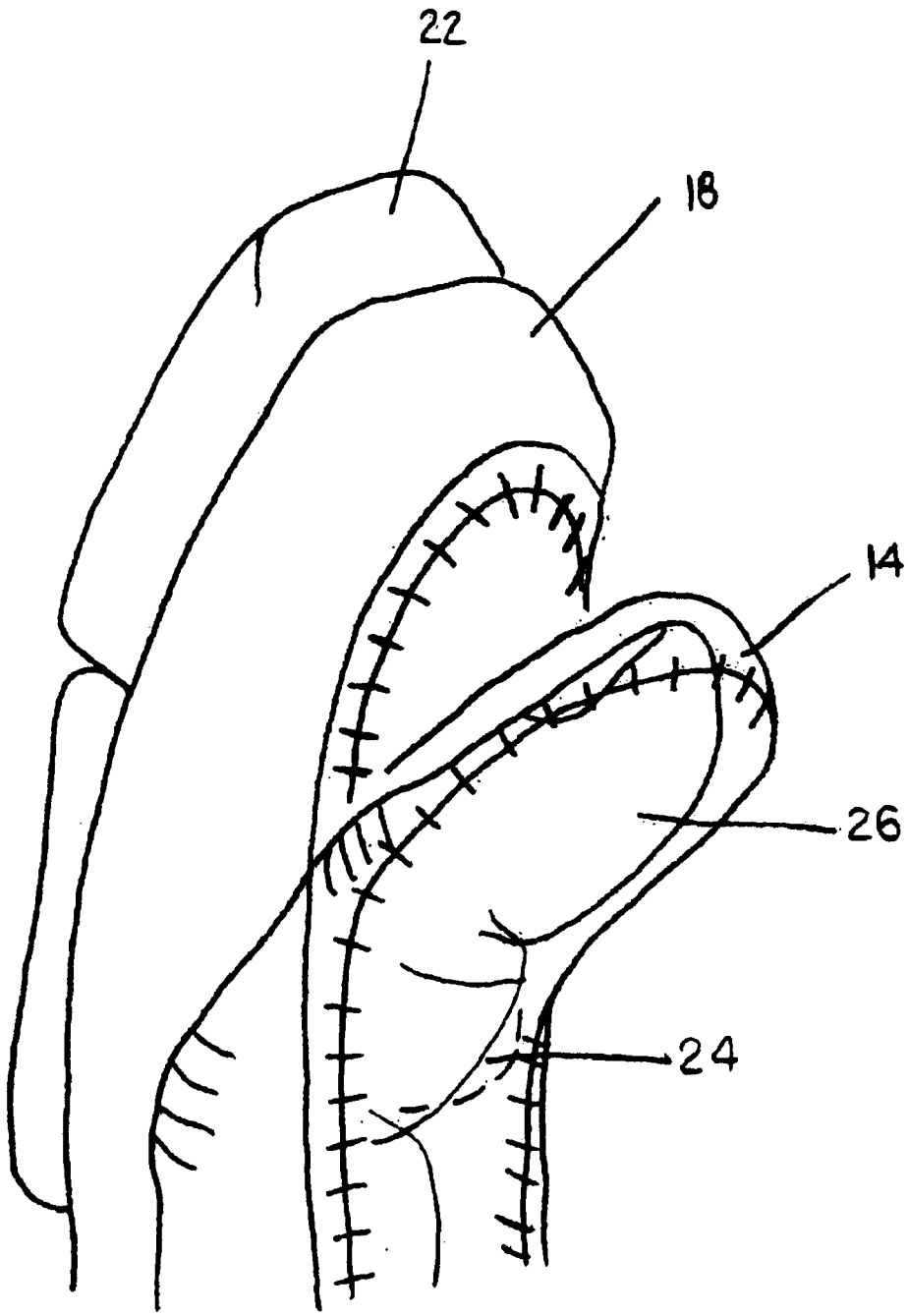
FIG. 4 is a perspective view of an additional glove finger with a finger inserted according to the present invention.

The present invention is a flexible finger system 10 for a hockey glove 12, as shown in FIGS. 1–9. The flexible finger system 10 is an additional glove finger(s) 14 extending from the palm section 16 of the hockey glove 12. The hockey glove 12 shown retains the traditional fingers 18 and thumb 20 which extend from the palm section 16 and are protected by the foam protective upper-layer 22. In addition to the traditional construction, the flexible finger system 10 includes a finger access hole 24 for each additional glove finger 14 which is added to the hockey glove 12. FIG. 1 shows four additional glove fingers 14. FIGS. 2–4 show an additional glove finger 14 positioned to receive an index finger. FIG. 3 shows the finger access hole 24. FIG. 4 shows a finger 26 of a player in the additional glove finger 14. The additional glove finger(s) 14 allows the player to place the finger or fingers of the player into the additional glove finger(s) 14. The additional glove finger(s) 14 allows the finger or fingers of the player to close around the hockey stick without pulling on the foam portions of the protective upper layer 22. The additional glove finger 14 allows the finger of the player to be independently flexible from just above the lower finger joint 28, while still being covered by the protective upper layer 22 and protected by the foam and cladding of the hockey glove 12. The use of the flexible finger system 10 gives the player a more natural feel as though the player was holding the stick with bare hands, without sacrificing any protection. The player has the option of using the flexible finger system 10 or using the hockey glove as though it was a hockey glove without the flexible finger system 10.

Figure 5:
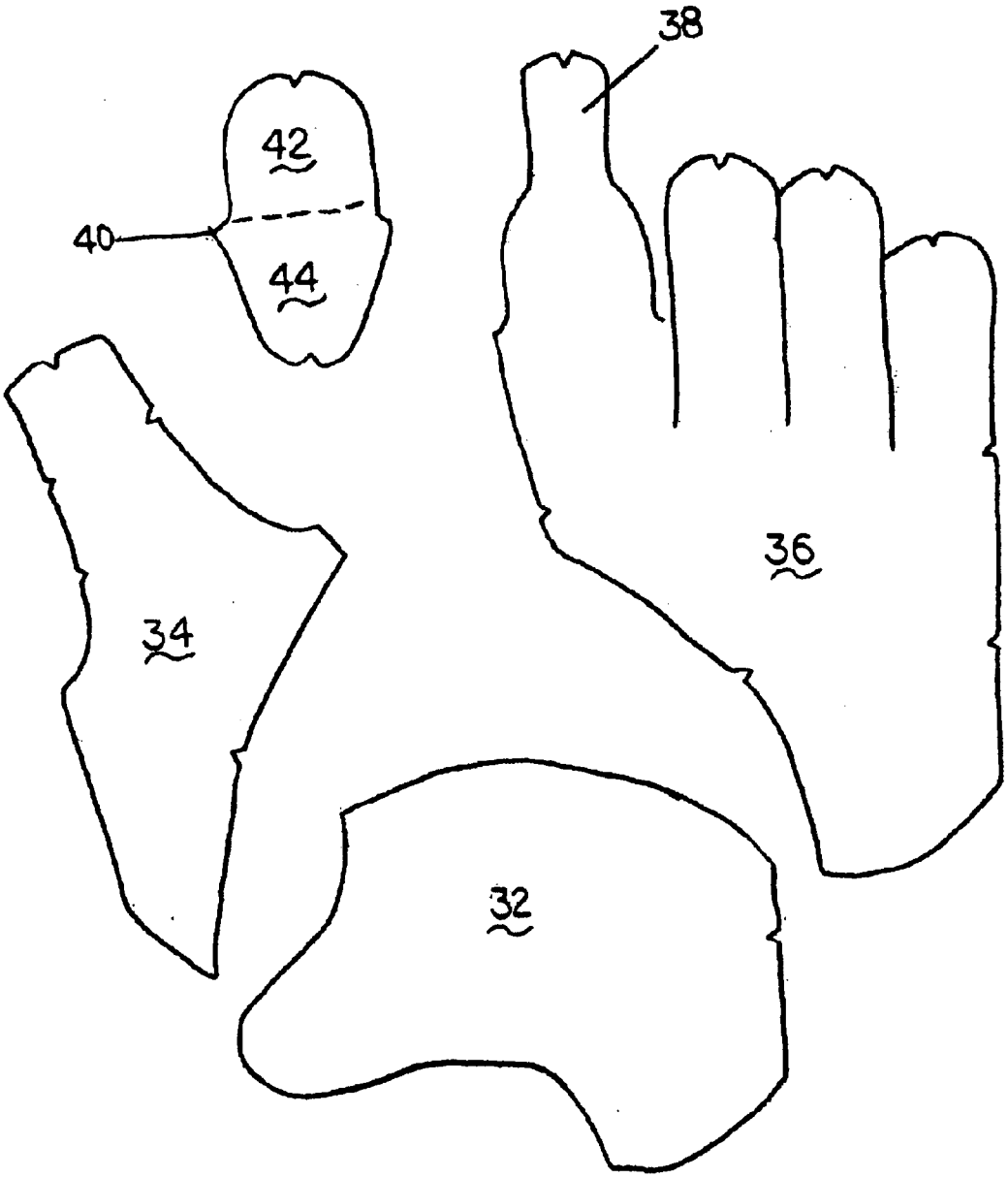
FIG. 5 is a schematic view of a bottom of a hockey glove according to the present invention.
Figure 6:
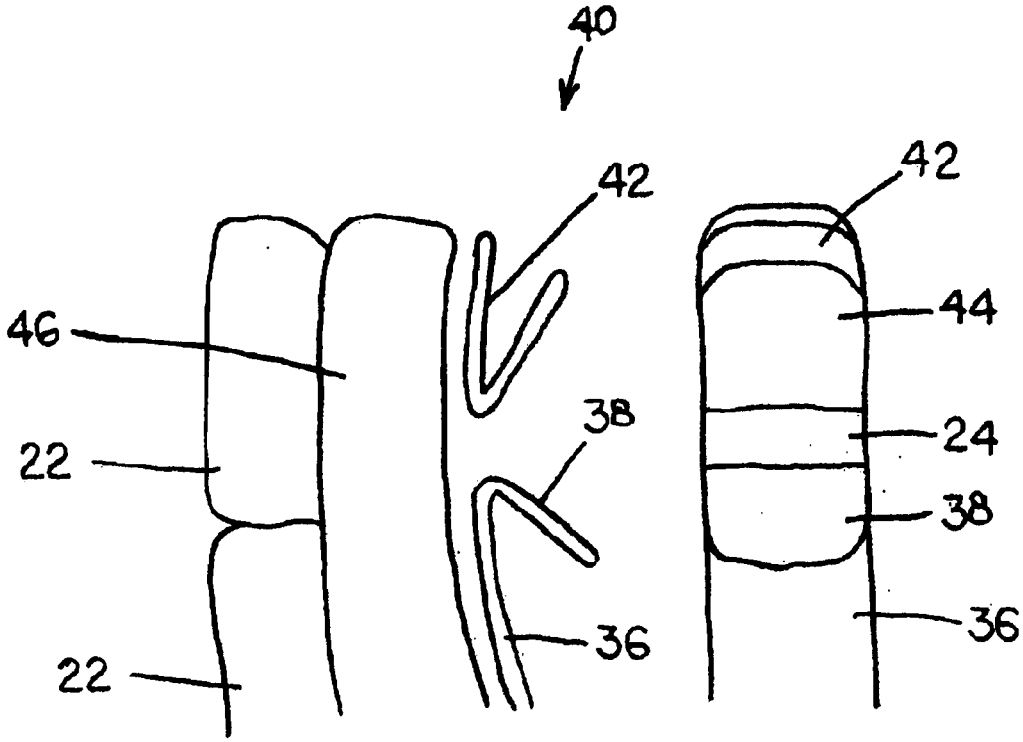
FIG. 6 is a side and front view of an unassembled additional glove finger according to the present invention.
Figure 7:
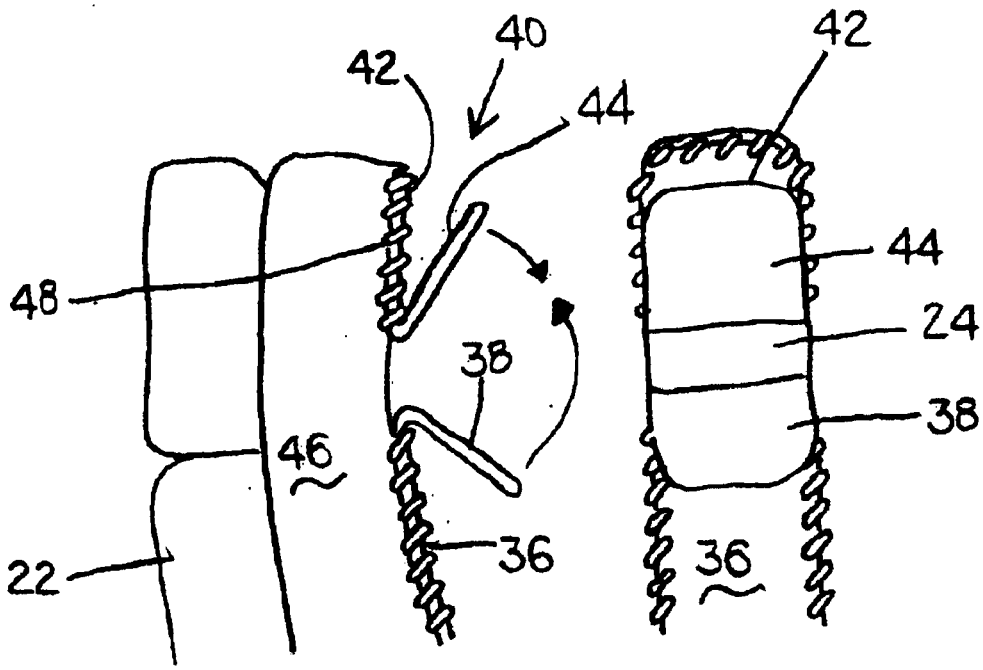
FIG. 7 is a side and front view of a partially assembled additional glove finger according to the present invention.
Figure 8:
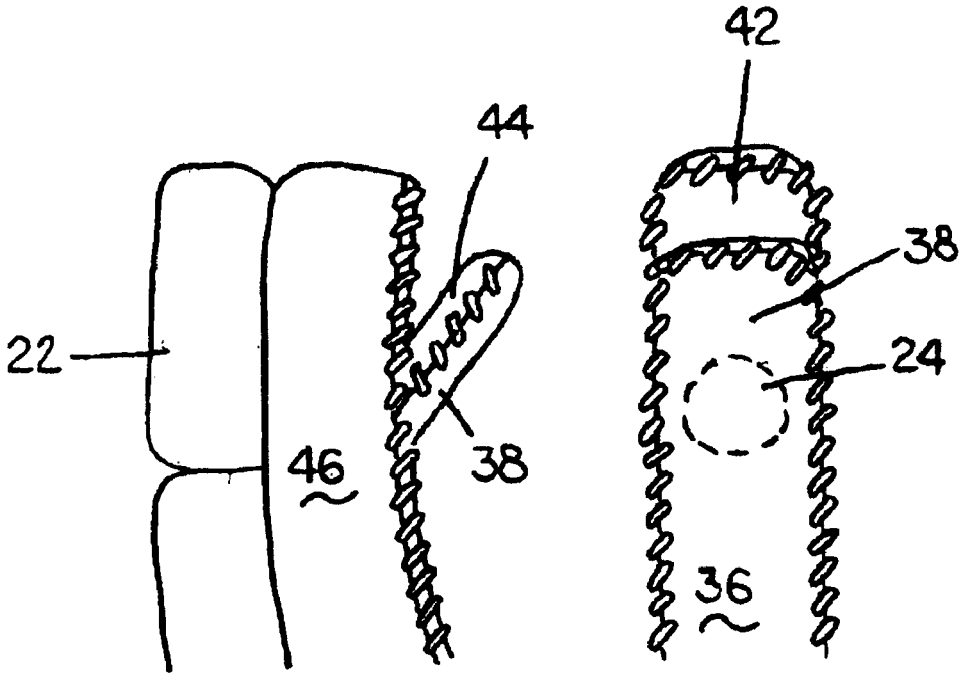
FIG. 8 is a side and front view of an assembled additional glove finger according to the present invention.
Figure 9:
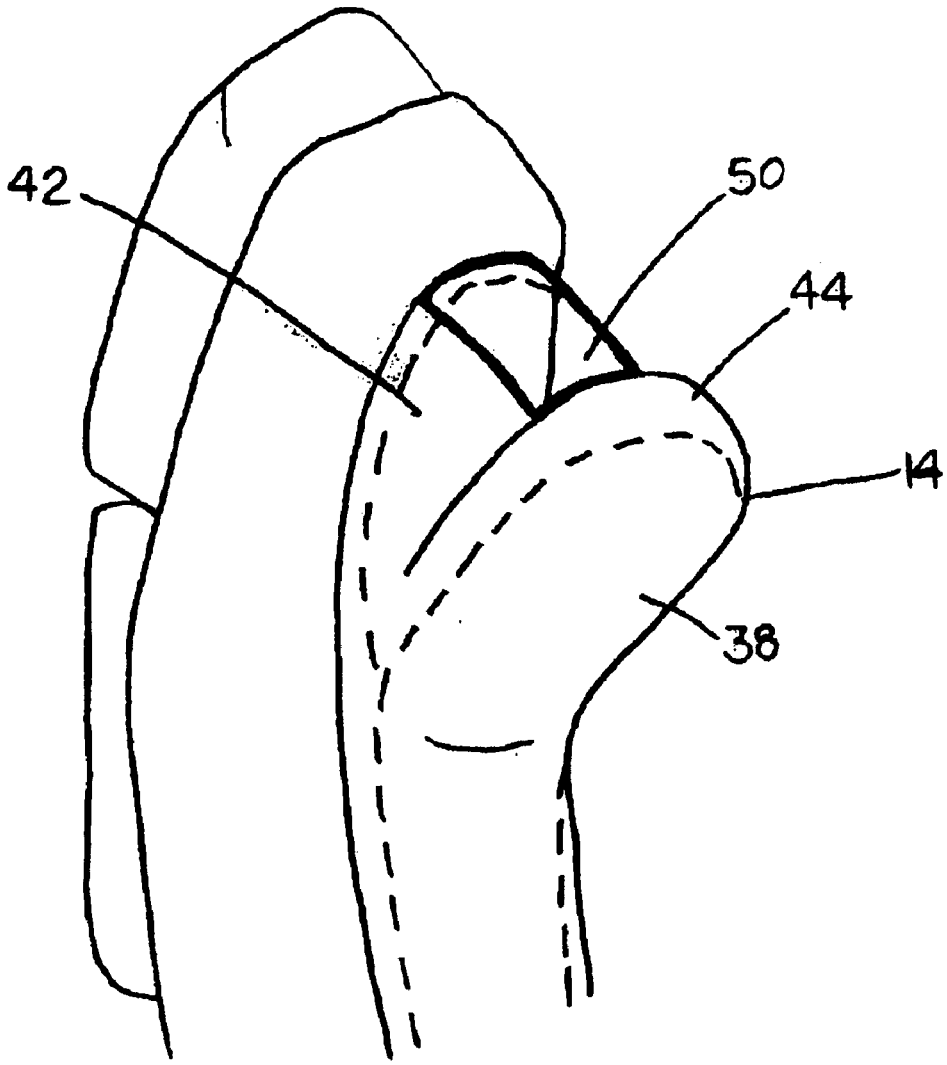
FIG. 9 is a perspective view of a restraining strap attached to an additional glove finger according to the present invention.

The flexible finger system 10 can be manufactured in numerous ways and is meant to provide a better feeling fit and comfort for the hockey player, as well providing an improved grip on the hockey stick. FIGS. 5–8 show one method of manufacturing the additional glove fingers 14 on a hockey glove 12. FIG. 5 shows the typical parts to the bottom 30 of a hockey glove 12, which include the palm section 32, thumb section 34 and finger section 36 that are sewn together to form the bottom 30. Additionally shown in FIG. 5 is a finger tab 38 on the finger section 36 and an additional finger section 40. Whereby, the finger tab 38 and additional finger section 40 form the additional glove finger 14 of the flexible finger system 10. The additional finger section 40 includes a glove section 42 and a flexible finger section 44. FIG. 6 shows the finger section 36 with the finger tab 38 and the additional finger section 40 just before attachment to the sides 46 of the hockey glove 12. FIG. 6 shows the finger tab 38 folded downward and the flexible finger section 44 folded upward. FIG. 7 shows the finger section 40 sewn with stitches 48 to the sides 46 of the hockey glove 12 with the finger tab 38 folded downward and unattached. FIG. 7 also shows the glove section 42 of the additional finger section 40 sewn with stitches 48 to the sides 46 of the hockey glove 12 and the flexible finger section 44 folded upward. FIG. 8 shows the flexible finger section 44 and the finger tab 38 sewn together with stitches 48 to form the additional glove finger 14, whereby the finger access hole 24 is naturally formed by the additional finger section 40 and the finger tab 38. FIG. 9 shows a optional restraining strap 50 attached between the top of glove section 42 and the top of the flexible finger section 44 of the additional finger section 40. The restraining strap 50 retains the additional glove finger 14 in close proximity to the foam protective upper layer 22.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A flexible finger system for a hockey glove comprising:

a hockey glove having a hand area to receive a hand including finger areas and a thumb area to receive fingers and a thumb of a player, said glove having an upper layer and a lower layer which form said hand area, said lower layer covering a bottom of said hand and including a palm section, said bottom including fingers and a thumb extending from said palm section, said glove including sides between said lower layer and said upper layer forming said finger and thumb areas to receive said fingers and thumb of said player;

at least one finger access hole in at least one of said fingers of said bottom;

an additional glove finger extending about and from said at least one finger access hole for each of said at least one finger access hole, said additional glove finger covering said one of said fingers of said player, said additional glove finger being mobile from said finger area associated with said finger of said bottom which has said at least one finger access hole, said additional glove finger allowing a player to choose placement of said finger of said player between either said finger area associated with said at least one finger access hole and said additional glove finger extending from said at least one finger access hole.

2. The flexible finger system of claim 1, wherein said additional glove finger is independently flexible at a lower finger joint of said finger of said player.

3. The flexible finger system of claim 2, wherein said additional glove finger is formed by an additional finger section attached to said sides and a finger tab extending from one of said fingers of said bottom and attached to said additional finger section; said additional finger section including a glove section and a flexible finger section; said glove section attached to said sides; said flexible finger section attached to said finger tab; and wherein the attachment of said flexible finger section and said finger tab naturally forms said finger access hole.

4. The flexible finger system of claim 3, further including a restraining strap attached between said glove section and said flexible finger section associated with said additional glove finger.

5. The flexible finger system of claim 4, wherein said additional glove finger is independently flexible at a lower finger joint of said finger of said player.

6. The flexible finger system of claim 2, further including a restraining strap attached between said additional glove finger and said finger of said bottom associated with said additional glove finger.

7. The flexible finger system of claim 1, wherein said at least two fingers of said bottom each include said finger access hole and said additional glove finger.

8. The flexible finger system of claim 7, wherein each of said additional glove fingers is formed by an additional finger section attached to said sides and a finger tab extending from one of said fingers of said bottom and attached to said additional finger section; said additional finger section including a glove section and a flexible finger section; said glove section attached to said sides; said flexible finger section attached to said finger tab; and wherein the attachment of said flexible finger section and said finger tab naturally forms said finger access hole.

9. The flexible finger system of claim 8, further including a restraining strap attached between said glove section and said flexible finger section associated with said additional glove finger.

10. The flexible finger system of claim 9, wherein said additional glove finger is independently flexible at a lower finger joint of said finger of said player.

11. The flexible finger system of claim 7, further including a restraining strap attached between said additional glove finger and said finger of said bottom associated with said additional glove finger.

12. The flexible finger system of claim 1, wherein said four fingers of said bottom each include said finger access hole and said additional glove finger.

13. The flexible finger system of claim 12, wherein each of said additional glove fingers is formed by an additional finger section attached to said sides and a finger tab extending from one of said fingers of said bottom and attached to said additional finger section; said additional finger section including a glove section and a flexible finger section; said glove section attached to said sides; said flexible finger section attached to said finger tab; and wherein the attachment of said flexible finger section and said finger tab naturally forms said finger access hole.

14. The flexible finger system of claim 13, further including a restraining strap attached between said glove section and said flexible finger section associated with said additional glove finger.

15. The flexible finger system of claim 14, wherein said additional glove finger is independently flexible at a lower finger joint of said finger of said player.

16. The flexible finger system of claim 12, further including a restraining strap attached between said additional glove finger and said finger of said bottom associated with said additional glove finger.

17. The flexible finger system of claim 1, wherein said additional glove finger is formed by an additional finger section attached to said sides and a finger tab extending from one of said fingers of said bottom and attached to said additional finger section; said additional finger section including a glove section and a flexible finger section; said glove section attached to said sides; said flexible finger section attached to said finger tab; and wherein the attachment of said flexible finger section and said finger tab naturally forms said finger access hole.

18. The flexible finger system of claim 17, further including a restraining strap attached between said glove section and said flexible finger section associated with said additional glove finger.

19. The flexible finger system of claim 1, further including a restraining strap attached between said additional glove finger and said finger of said bottom associated with said additional glove finger.

20. The flexible finger system of claim 19, wherein said additional glove finger is independently flexible at a lower finger joint of said finger of said player.

* * * * *